United States Patent [19]

Lin

[11] Patent Number: 5,069,207

[45] Date of Patent: Dec. 3, 1991

[54] PHYSIOTHERAPY HEALTHY DEVICE

[76] Inventor: Shin-Hsiung Lin, 3, Alley 40, Sun-Chu Rd., Chang-Hua, Taiwan

[21] Appl. No.: 556,317

[22] Filed: Jul. 23, 1990

[51] Int. Cl.[5] ..... A61H 33/00

[52] U.S. Cl. ..... 128/366; 128/367; 128/373; 4/536; 4/527; 4/529

[58] Field of Search ..... 4/535, 536, 524, 527, 4/528, 529, 534; 128/371, 373, 366, 367, 365, 376

[56] References Cited

U.S. PATENT DOCUMENTS

| | | | |
|---|---|---|---|
| 148,487 | 3/1874 | Miller et al. | 4/527 |
| 1,128,564 | 2/1915 | Wilson | 4/528 |
| 1,144,861 | 6/1915 | Payeur | 4/528 |
| 1,183,971 | 5/1916 | Greer et al. | 4/528 |
| 1,790,364 | 1/1931 | Bender et al. | 4/528 |
| 2,311,899 | 2/1943 | Marlowe | 4/536 |
| 2,333,231 | 11/1943 | Berg | 128/373 |
| 2,346,827 | 4/1944 | Cotter | 4/527 |
| 4,565,188 | 1/1986 | Hardie | 4/524 |

FOREIGN PATENT DOCUMENTS

| | | | |
|---|---|---|---|
| 0300577 | 1/1989 | European Pat. Off. | 4/524 |
| 3505707 | 8/1985 | Fed. Rep. of Germany | 4/524 |
| 3511436 | 10/1986 | Fed. Rep. of Germany | 4/524 |
| 0107764 | 4/1989 | Japan | 4/524 |

*Primary Examiner*—Edward M. Coven
*Assistant Examiner*—Mark S. Graham
*Attorney, Agent, or Firm*—Larson & Taylor

[57] ABSTRACT

A physiotherapy device includes a bed structure having a horizontally disposed upper plate with a plurality of orifices. An apertured plate which forms a network having apertures rests on the upper plate. A plurality of spray nozzles are mounted below respective orifices for spraying upwardly through the orifices and the apertured plate. A shade and canvas provide a space for the user and are raisable and lowerable. A mounting means is provided for mounting the shade for pivoting movement about a horizontal axis. A controller then includes a heating tank filled with a suitable physiotherapeutic liquid, a conduit for delivering the heated liquid to the spray nozzles, and a control unit for controlling a heating of the liquid in the heating tank and a period of delivery of the liquid to the spray nozzles.

10 Claims, 3 Drawing Sheets

PHYSIOTHERAPY HEALTHY DEVICE

BACKGROUND OF THE INVENTION

Most office clerks currently experience only a very limited amount of exercise and work under an air-conditioned environment, so that they hardly ever have a heavy, cleansing sweat. However, manual labor workers often get exhausted and worn out from hard work and overfatigue and do frequently have a heavy cleansing sweat.

In view of this difference, a vapor physiotherapy structure to promote health and a healthy sweat is provided by the present invention.

SUMMARY OF THE INVENTION

The present invention is a health promoting device having a shade with a covering canvas. A conduit located in a base structure is connected to a herb tank. There are numerous orifices mounted on a bedstead above the nozzles. The shade comprises several semi-circular fixed supports. Several horizontal pipes having a plurality of nozzles mounted thereto are in turn mounted on the respective inner sides of the structure. A plurality of fine orifices are provided on the top end of each nozzle.

The herb tank is mounted on the bottom end of a controller. The controller includes a control circuit, four insulating wheels on the bottom, a temperature control/setting gauge, a time control/setting gauge, a power switch, a temperature switch, indicator lamps, a voltage/current meter, and a temperature micro-adjustment knob. These are located on a panel at the upper end of the herb tank to control the temperature of a liquid provided in the herb tank.

DETAILED DESCRIPTION OF THE INVENTION

Figure 1:
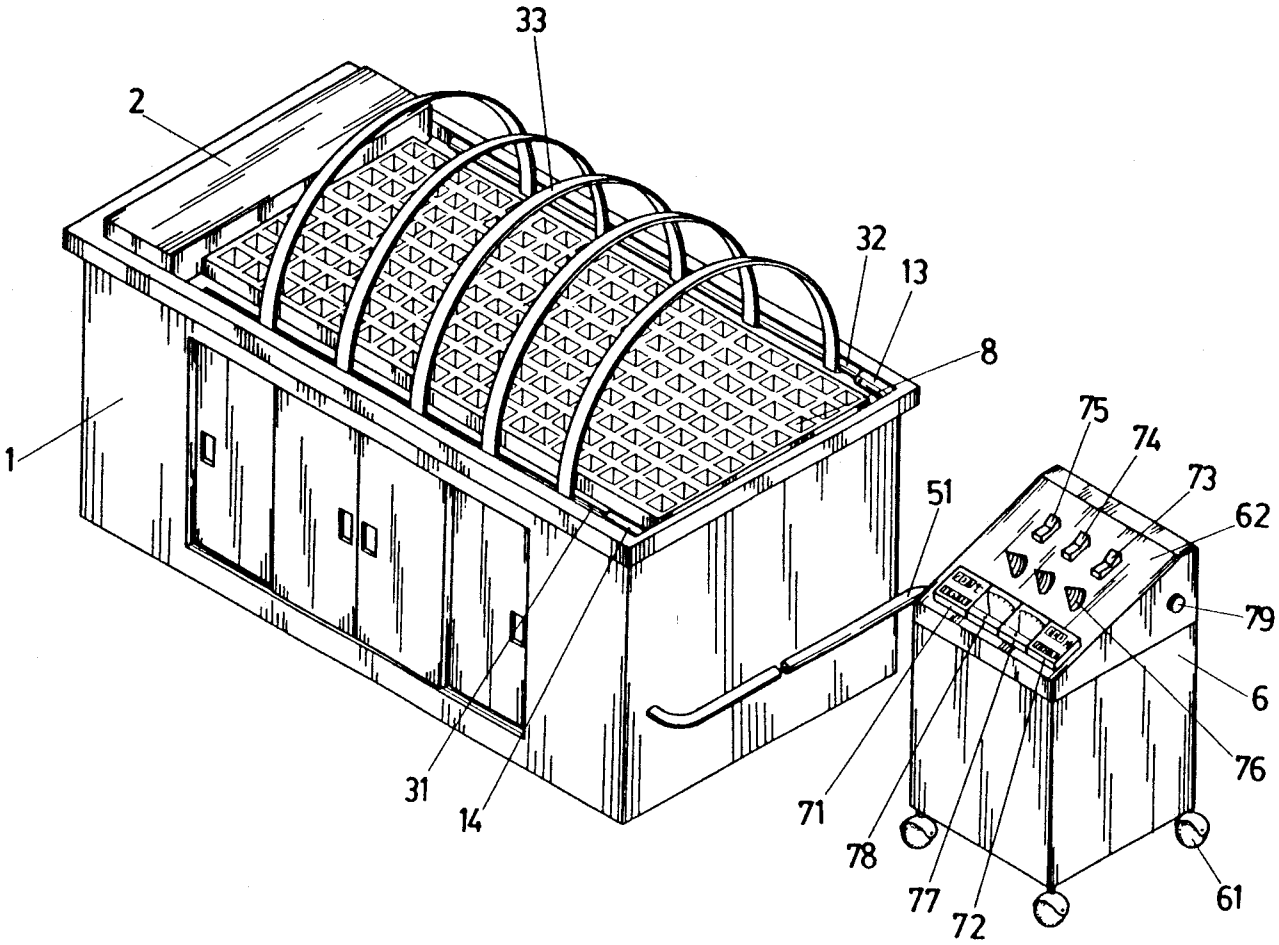
FIG. 1 is an elevational perspective view of the device of the present invention.
Figure 2:
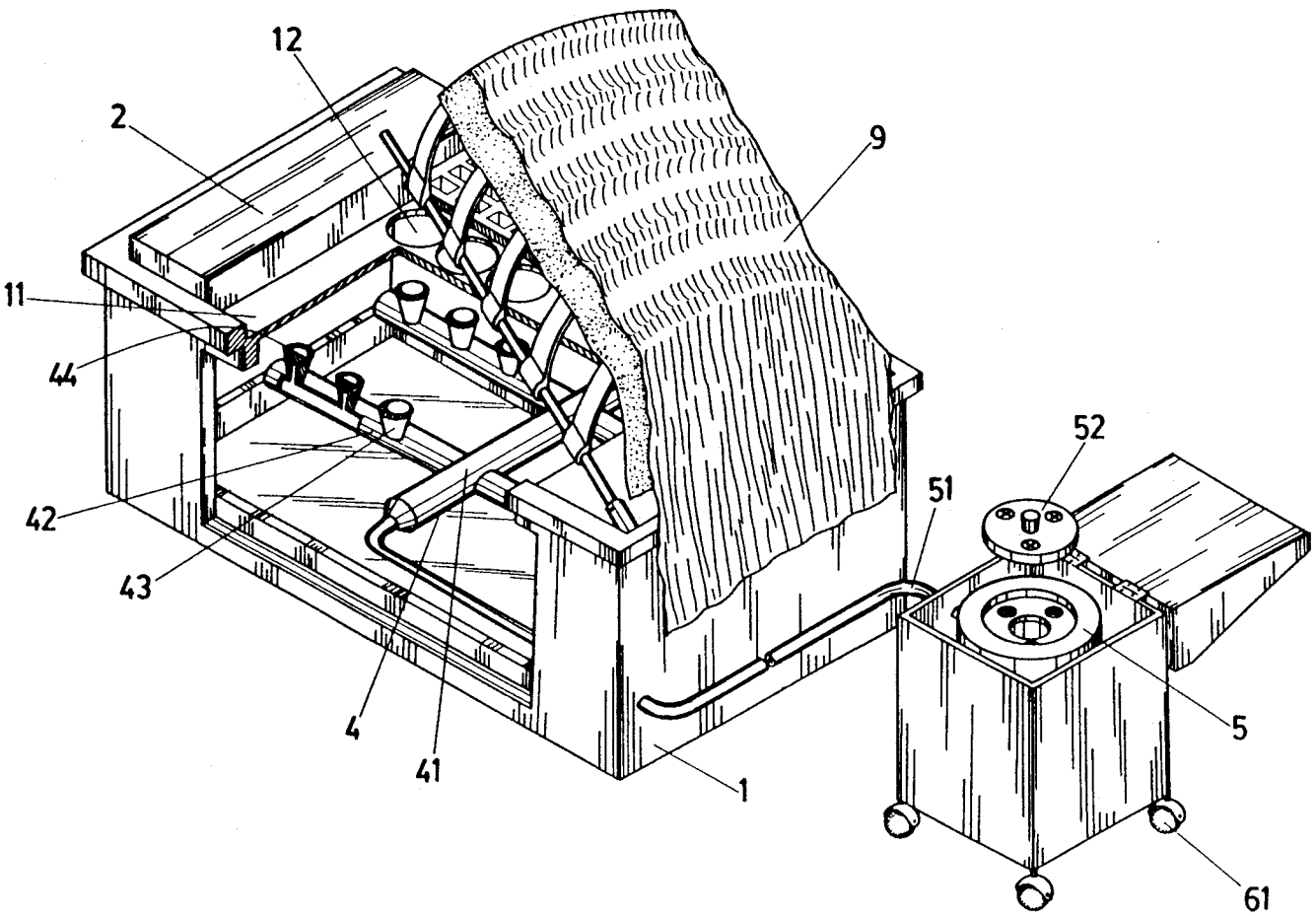
FIG. 2 is an partially cutaway elevational perspective view of the device depicted in FIG. 1 but with parts moved relative to FIG. 1.

Referring to FIGS. 1 and 2, the present invention includes an upper end plate 11 of a device (bed) or structure 1 having a plurality of orifices 12. A pillow 2 is mounted at the leading end of the upper end plate 11, and a netting plate 8 is laid on the upper end plate 11. Pivotable support plates 13, 14 are respectively mounted on each side at the rear end of the upper end plate 11. Frame portions of the support plates 13, 14 have connected thereto vertically movable horizontal bars 31, 32, and horizontal bars 31, 32 have connected thereto several spaced semi-circular supports 33. A conduit 4 mounted lower down in the bed structure 1 connects to several horizontal pipes 42 respectively mounted at each side of a lateral pipe 41 of the conduit 4. A plurality of nozzles 43 in a row at the upper end of each horizontal pipe 42 include a plurality of fine orifices 44.

Lateral pipe 41 is fluidly connected to a conduit 51 of a controller 6. Conduit 51 connects to an upper end of a herb tank 5 having a heater. Four insulating wheels 61 are located at the bottom of the controller 6. A control circuit 62 is mounted at the upper end of controller 6. Control circuit 62 includes a temperature control/setting gauge 71, a time control/setting gauge 72, a power switch 73, temperature switches 74, 75, indicator lamps 76, a voltage meter 77 and a current meter 78. Control circuit 62 is used both to control and to indicate the operating condition of the whole system.

Figure 3:
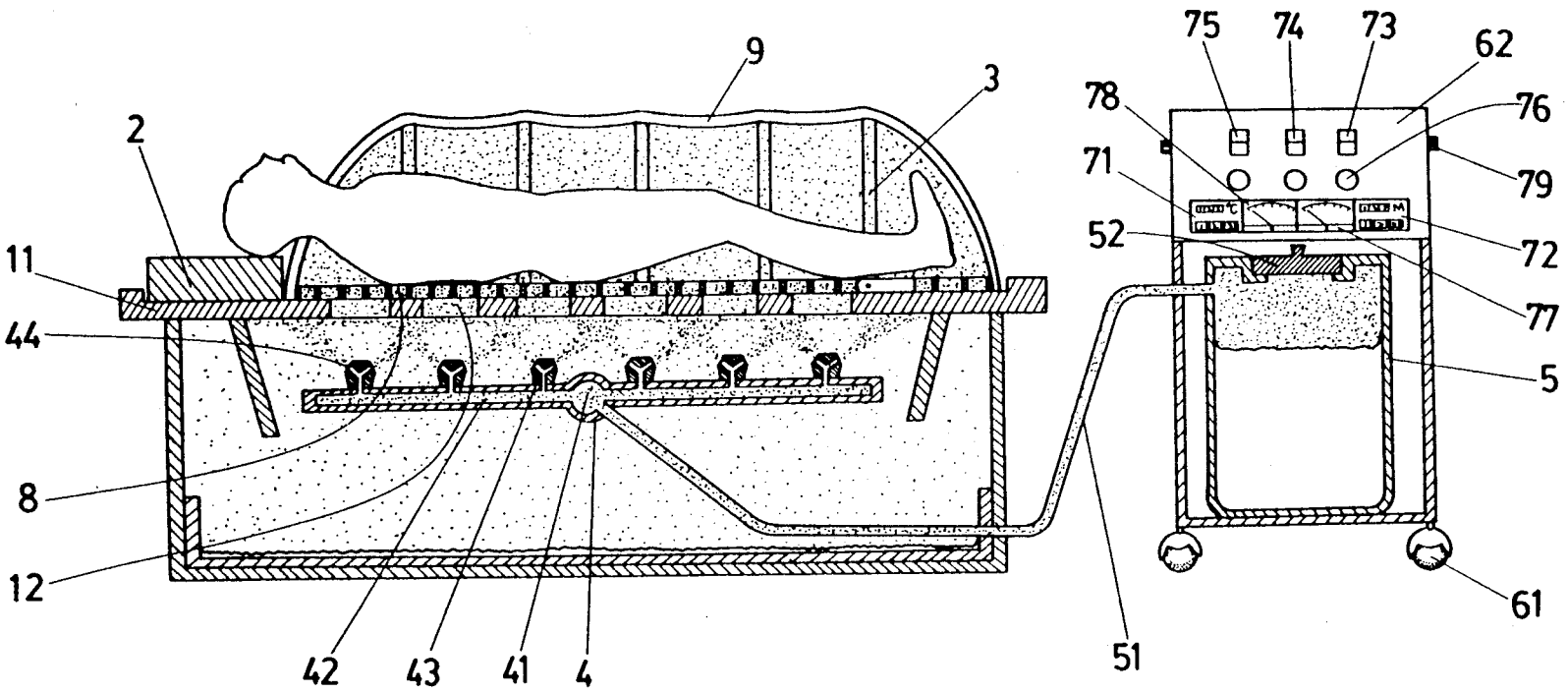
FIG. 3 is a diagrammatic elevational view in cross section of the device of in FIG. 1, showing it in use.

Referring to FIG. 3, when the user lies down, the shade 3 (comprising supports 33 and movable horizontal bars 31, 32) is already vertically raised upwardly under the support of supporting plates 13, 14. Before the user begins to use the device, a chemical solution is added to herb tank 5 in the controller 6. After closing the upper cover 52 and covering it with the controller 62, the power switch 73 and temperature switch 75 are turned on so that the chemical tank 5 starts heating. Meanwhile, the temperature control/setting gauge 71 and time control/setting gauge 72 are set to the desired setting. Then, as soon as the chemical solution within the chemical tank 5 is heated up to the set temperature, the chemical solution is drawn into the conduit 51 and delivered to the conduit 4 whereby the user begins to receive a spray of the chemical solution and hence of the desired therapy.

With the user lying on the netting plate 8 of the upper end plate 11 of the bed structure 1, the shade 3 is lowered into place before the spraying starts so that the canvas 9 covers the whole shade 3 and the user. The high temperature chemical solution transmitted from the chemical tank 5 is thus sprayed out of the nozzles 43 of the conduit 4, evenly spreading within the shade 3 through orifices 12 on the upper end plate 11 of bed structure 1 and netting plate 8. The high temperature vapor containing chemicals will be partially absorbed by the body of the user through the pores of the user and will cause the user to sweat heavily so as to result in a vapor physiotherapy. When the setting time is up, the controller 6 turns off the temperature switch.

It should be appreciated that during the process of heating, temperature can be adjusted more accurately by adjusting the temperature micro-adjustment knob 79 so as to complete a whole health maintenance procedure.

The present invention is particularly characterized by having the user lie flat instead of the conventional sitting/lying so that the user may feel more comfortable in this position within the specially designated shade. Under high temperature vapor conditions, the user not only can sweat adequately, but also can sufficiently absorb the chemicals contained in the vapor as a result of the expanding (sweating) pores. Moreover, as the user is lying flat, vapors with chemicals therein can spread over the whole body evenly so as to obtain a better effect of health maintenance.

I claim:

1. A physiotherapy device comprising:

a bed structure having a generally horizontally disposed upper plate, said upper plate having a length sufficient for a user to lay longitudinally therealong and a plurality of orifices therein;

an apertured plate which forms a network having apertures and which rests on said upper plate wherein the user lies on the apertured plate;

a plurality of spray nozzles, each of which is mounted below a respective said orifice of said upper plate for spraying upwardly through said orifices and said apertured plate;

a shade including supports providing a space therebeneath for a user, and a canvas covering said supports, said shade and canvas being raisable and lowerable to permit the user to enter and lie down on the apertured plate; and a controller including a heating tank filled with a suitable physiotherapeutic liquid, a conduit means for delivering the heated liquid to said spray nozzles, and a control unit for controlling a heating of the liquid in said heating tank and the timing of delivery of the liquid to said spray nozzles.

2. A physiotherapy device as claimed in claim 1, wherein the orifices in the upper plate are located along respective longitudinal sides thereof.

3. A physiotherapy device as claimed in claim 1, wherein the shade comprises a pair of side bars and a plurality of upwardly bowed supports connected thereto.

4. A physiotherapy device as claimed in claim 3, including mounting means for pivoting the side bars and bowed supports upwardly and downwardly about a pivot axis located at one end of the device.

5. A physiotherapy device as claimed in claim 3, including a pillow located at an end of the device.

6. A physiotherapy device as claimed in claim 1 wherein said heating tank includes a removable cover, and wherein said conduit means is connected to a side of said heating tank adjacent a top of said heating tank.

7. A physiotherapy device as claimed in claim 1 wherein said heating tank is located at a bottom of said controller; and wherein said controller includes an upper end, said upper end being movably mounted to a remainder of said controller and containing said control unit.

8. A physiotherapy device as claimed in claim 7 wherein said upper end includes a panel provided with a temperature control/setting gauge, a temperature selective switch, and a temperature micro-adjustment knob for fine control of the heating of the liquid in said heating tank.

9. A physiotherapy device as claimed in claim 8 wherein said panel further includes a power switch, indicator lamps, a voltage meter, and a current meter.

10. A physiotherapy device as claimed in claim 8 wherein said controller further includes wheels whereby said controller is easily movable.

* * * * *